US005778807A

United States Patent [19]

Nishizawa et al.

[11] Patent Number: 5,778,807

[45] Date of Patent: Jul. 14, 1998

[54] EYELET-END BUTTONHOLE SEWING MACHINE WHEREIN STITCHING DATA IS COMPENSATED ACCORDING TO A DESIGNED ONE OF COMPENSATION DATA SETS

[75] Inventors: Yoshifumi Nishizawa, Tokyo; Jun Gamano, Okazaki; Hideo Ando, Konan; Akihiro Funahashi, Handa, all of Japan

[73] Assignees: Mitsubishi Denki Kabushiki Kaisha, Tokyo; Brother Kogyo Kabushiki Kaisha, Nagoya, both of Japan

[21] Appl. No.: 747,383

[22] Filed: Nov. 12, 1996

[30] Foreign Application Priority Data

Nov. 15, 1995 [JP] Japan ..... 7-322245

[51] Int. Cl.[6] ..... D05B 3/08

[52] U.S. Cl. ..... 112/70; 112/446; 112/470.06

[58] Field of Search ..... 112/446, 456, 112/470.06, 475.25, 65, 66, 70

[56] References Cited

U.S. PATENT DOCUMENTS 4,495,878 1/1985 Asai et al. ..... 112/456 X 4,502,401 3/1985 Asai et al. ..... 112/475.25 X 5,222,449 6/1993 Koie et al. ..... 112/475.25 X

FOREIGN PATENT DOCUMENTS 4-261694 9/1992 Japan .

4-261695 9/1992 Japan .

*Primary Examiner*—Peter Nerbun

*Attorney, Agent, or Firm*—Oliff & Berridge, PLC

[57] ABSTRACT

A buttonhole sewing machine including stitching instrumentalities for forming zigzag stitches defining an eyelet-end buttonhole having an eyelet end portion at one end of a foot portion, by operations of a driving mechanism for operating a needle and looper device of the stitching instrumentalities, a feeding mechanism for feeding work fabric feeding table along X and Y axes, and a rotating mechanism for rotating a needle bar and looper base about an axis perpendicular to the X and Y axes, according to stitching data, and wherein the stitching data are compensated by a control device according to a designated one of compensation data sets stored in a compensation data memory.

15 Claims, 10 Drawing Sheets

FIG. 4

37a

| | STITCHES | X-AXIS MOTOR STEPS | Y-AXIS MOTOR STEPS | θ-AXIS MOTOR STEPS |
|---|---|---|---|---|
| FR | 1N <1> → (1) | 0 | 20 | 0 |
| | 2N <2> → (2) | 0 | 20 | 0 |
| | 3N <3> → (3) | 0 | 20 | 0 |
| DE | 4N <4> → (4) | 0 | 20 | 0 |
| | 5N <5> → (5) | 8 | 20 | 0 |
| | 6N <6> → (6) | 8 | 20 | 0 |
| | 7N <7> → (7) | −5 | 10 | 45 |
| | 8N <8> → (8) | −12 | 5 | 45 |
| | 9N <9> → (9) | −12 | −5 | 45 |
| | 10N <10> → (10) | −5 | −10 | 45 |
| | 11N <11> → (11) | 8 | −20 | 0 |
| | 12N <12> → (12) | 8 | −20 | 0 |
| FL | 13N <13> → (13) | 0 | −20 | 0 |
| | 14N <14> → (14) | 0 | −20 | 0 |
| | 15N <15> → (15) | 0 | −20 | 0 |
| | 16N <16> → (16) | 0 | −20 | 0 |

FIG. 6

37b

| COMPENSATED STITCHES | NOMINAL COMPENSATING VALUE | | | | | | |
|---|---|---|---|---|---|---|---|
| | −3 | −2 | −1 | 0 | +1 | +2 | +3 |
| <5> → (5) | +1 | 0 | 0 | 0 | 0 | 0 | −1 |
| <6> → (6) | +1 | +1 | +1 | 0 | −1 | −1 | −1 |
| <7> → (7) | +1 | +1 | 0 | 0 | 0 | −1 | −1 |
| <11> → (11) | −1 | −1 | 0 | 0 | 0 | +1 | +1 |
| <12> → (12) | −1 | −1 | −1 | 0 | +1 | +1 | +1 |
| <13> → (13) | −1 | 0 | 0 | 0 | 0 | 0 | +1 |

FIG. 7

37c

| COMPENSATED STITCHES | NOMINAL COMPENSATING VALUE | | | | | | |
|---|---|---|---|---|---|---|---|
| | −3 | −2 | −1 | 0 | +1 | +2 | +3 |
| <13> → (13) | −1 | −1 | −1 | 0 | +1 | +1 | +1 |
| <14> → (14) | −1 | −1 | 0 | 0 | 0 | +1 | +1 |
| <15> → (15) | −1 | 0 | 0 | 0 | 0 | 0 | +1 |

FIG. 8

37d

| COMPENSATED STITCHES | NOMINAL COMPENSATING VALUE | | | | | | |
|---|---|---|---|---|---|---|---|
| | −3 | −2 | −1 | 0 | +1 | +2 | +3 |
| <5> → (5) | −1 | −1 | −1 | 0 | +1 | +1 | +1 |
| <6> → (6) | −1 | −1 | 0 | 0 | 0 | +1 | +1 |
| <7> → (7) | −1 | 0 | 0 | 0 | 0 | 0 | +1 |
| <11> → (11) | +1 | 0 | 0 | 0 | 0 | 0 | −1 |
| <12> → (12) | +1 | +1 | 0 | 0 | 0 | −1 | −1 |
| <13> → (13) | +1 | +1 | +1 | 0 | −1 | −1 | −1 |

FIG. 9

37e

| COMPENSATED STITCHES | NOMINAL COMPENSATING VALUE | | | | | | |
|---|---|---|---|---|---|---|---|
| | −3 | −2 | −1 | 0 | +1 | +2 | +3 |
| <1> → (1) | −3 | −2 | −1 | 0 | +1 | +2 | +3 |
| <5> → (5) | +3 | +2 | +1 | 0 | −1 | −2 | −3 |
| <13> → (13) | −3 | −2 | −1 | 0 | +1 | +2 | +3 |

STITCHING DATA COMPENSATING ROUTINE

FIG. 13

37a

| | STITCHES | X-AXIS MOTOR STEPS | Y-AXIS MOTOR STEPS | θ-AXIS MOTOR STEPS |
|---|---|---|---|---|
| FR | 1N <1> → (1) | 0 | 20 | 3 |
| | 2N <2> → (2) | 0 | 20 | 0 |
| | 3N <3> → (3) | 0 | 20 | 0 |
| DE | 4N <4> → (4) | 0 | 20 | 0 |
| | 5N <5> → (5) | 8 | 20 | −2 |
| | 6N <6> → (6) | 7 | 20 | 1 |
| | 7N <7> → (7) | −6 | 10 | 46 |
| | 8N <8> → (8) | −12 | 5 | 45 |
| | 9N <9> → (9) | −12 | −5 | 45 |
| | 10N <10> → (10) | −5 | −10 | 45 |
| | 11N <11> → (11) | 9 | −20 | −1 |
| | 12N <12> → (12) | 9 | −20 | −1 |
| FL | 13N <13> → (13) | 0 | −21 | 2 |
| | 14N <14> → (14) | 0 | −21 | 0 |
| | 15N <15> → (15) | 0 | −20 | 0 |
| | 16N <16> → (16) | 0 | −20 | 0 |

EYELET-END BUTTONHOLE SEWING MACHINE WHEREIN STITCHING DATA IS COMPENSATED ACCORDING TO A DESIGNED ONE OF COMPENSATION DATA SETS

BACKGROUND OF THE INVENTION

1. Field of the Invention

The present invention relates in general to a sewing machine for stitching an eyelet-end buttonhole (keyhole type buttonhole) having a foot portion and an eyelet end portion at one end of the foot portion. More particularly, the present invention is concerned with techniques for facilitating compensation of stitching data so as to change stitching positions in the foot and eyelet end portions independently of each other.

2. Discussion of the Related Art

The foot portion of such an eyelet-end buttonhole generally consists of a pair of parallel side stitching parts which are spaced apart from each other by a suitable small distance in a direction perpendicular to the direction of extension of the foot portion from the eyelet end portion. The two parallel side stitching parts are connected at their ends by the eyelet end portion, and are stitched continuously with the eyelet end portion. A known buttonhole sewing machine capable of stitching such an eyelet-end buttonhole is provided with stitch-forming instrumentalities for forming zigzag stitches on a work fabric. Each zigzag stitch connects an inner stitching position and an outer stitching position. The stitch-forming instrumentalities include a vertically reciprocable needle bar, a sewing needle vertically reciprocated by the needle bar, and a looper base which incorporates loopers. The buttonhole sewing machine is further provided with a driving mechanism for operating the sewing needle and the loopers in synchronization with each other, to form the zigzag stitches, and a feeding table which is moved with the work fabric in a Y-axis direction parallel to the direction of extension of the foot portion of the eyelet-end buttonhole and in an X-axis direction perpendicular to the Y-axis direction. The buttonhole sewing machine further has a feeding mechanism for feeding the feeding table in the Y-axis and X-axis directions, and a rotating mechanism for rotating the needle bar and the looper base as a unit about a third axis perpendicular to the X- and Y-axis directions. The buttonhole sewing machine uses a control device for controlling the driving mechanism, feeding mechanism and rotating mechanism according to stitching data, to first stitch the right side stitching part of the linear foot portion of the eyelet-end buttonhole, then stitch the eyelet end portion, and finally stitch the left side stitching part of the foot portion, whereby the desired eyelet-end buttonhole is stitched on the work fabric.

The buttonhole sewing machine includes a stitching data memory storing a plurality of sets of stitching data representative of respective different eyelet-end buttonholes having different sizes (e.g., different length dimensions of the foot portion and/or different sizes of the eyelet end portion), so that a desired one of the eyelet-end buttonhole may be stitched according to the corresponding set of stitching data.

A sewing operation to stitch an eyelet-end buttonhole on the work fabric may involve undesirable local tensioning and/or creasing of the work fabric, depending upon the properties of the work fabric such as material, thickness and stretch property (elasticity) thereof, the properties of a sewing thread such as thickness and lengthwise elasticity thereof, and the tension given to the sewing thread. The local tensioning or creasing of the work fabric causes deviation of the stitching positions in the foot and eyelet end portions of the buttonhole, from the nominal positions as defined by the stitching data which are formulated to give the worked buttonhole to have a neat stitch pattern appearance.

The two side stitching parts of the foot portion are stitched linearly along two parallel straight lines, while the eyelet end portion is stitched semi-circularly along a circular arc or curve. As a result, the distance of the outer stitching positions from the inner stitching positions in the foot portion tends to differ from that in the eyelet end portion. Further, the stitching positions in the left side stitching part of the foot portion tend to be displaced from those in the right side stitching part. Thus, the stitched eyelet-end buttonhole may have an asymmetric unpleasant stitch pattern appearance.

JP-A-261694 and JP-A-4-261695 disclose examples of eyelet-end buttonhole sewing machines capable of changing the outer stitching positions with respect to the inner stitching positions. These sewing machines include a driving mechanism for operating the needle bar and the looper device, a rotating mechanism for rotating the looper base and the needle bar, a feeding mechanism for feeding the feeding table in the X-axis and Y-axis directions, and an operation control panel. The operation control panel has a liquid crystal display, a selector key, an increment key and a decrement key. By manipulating these keys on the operation control panel, the operator may enter compensation data for compensating or changing the standard stitching data originally stored in a stitching data memory. Described in detail, the stitching data for a selected one of the stitches may be compensated in a selected one of the X-axis, Y-axis directions and a direction of rotation of the needle bar and looper base by the rotating mechanism. To this end, the identification numbers of the stitches whose stitching data are to be compensated must be specified through the keys, and the amount of compensation in the selected direction for each specified stitch must also be entered through the keys. The eyelet-end buttonhole is stitched according to the standard stitching data as compensated according to the compensation data entered through the operation control panel.

In the eyelet-end buttonhole sewing machines disclosed in the above-identified Publications JP-A-4-261694 and JP-A-4-261695, the stitching positions in the eyelet end portion can be compensated as desired by the operator, according to the compensation data entered through the operation control panel. However, the operator is required to specify each of the stitches whose stitching data are to be compensated, and enter the desired amount of compensation for each of the specified stitches. Moreover, the operator is required to enter the desired amounts of compensation in the three directions. Thus, the procedure required to compensate the original stitching data is complicated and cumbersome. Further, compensation of the stitching data must be repeated in a trial-and-error manner until the stitched buttonhole has a neat stitch pattern appearance, each time the work fabric is changed (its material or elasticity is changed) or each time the tension of the sewing thread is adjusted. Accordingly, the sewing efficiency in stitching the eyelet-end buttonhole is undesirably lowered.

SUMMARY OF THE INVENTION

It is therefore a first object of the present invention to provide an eyelet-end buttonhole sewing machine which permits easy, efficient compensation of stitching data of the foot and eyelet end portions of the eyelet-end buttonhole independently of each other, to assure a neat stitch pattern appearance of the stitched buttonhole, irrespective of a sewing condition as determined by the properties of the work fabric and sewing thread and the tension of the thread.

It is a second object of the present invention to provide a recording medium which is accessible by a computer of a sewing machine and which stores a plurality of sets of compensation data for compensating stitching data for an eyelet-end buttonhole as indicated above.

The first object indicated may be achieved according to a first aspect of the present invention, which provides a buttonhole sewing machine for forming on a work fabric zigzag stitches defining an eyelet-end buttonhole including a foot portion and an eyelet end portion formed at one end of the foot portion, each of the zigzag stitches connecting an inner stitching position and an outer stitching position, the buttonhole sewing machine comprising: (a) stitch-forming instrumentalities including a sewing needle attached to a needle bar and, a looper device disposed in a looper base, the needle and the looper device cooperating to form the zigzag stitches; (b) a driving mechanism for operating the sewing needle and the looper device in synchronization with each other, to form the zigzag stitches successively; (c) a feeding table movable with the work fabric placed thereon, in a Y-axis direction parallel to a direction of extension of the foot portion from the eyelet end portion and an X-axis direction perpendicular to the Y-axis direction; (d) a feeding mechanism for feeding the feeding table in the Y-axis and X-axis directions independently, when the sewing needle is placed above the work fabric; (e) a rotating mechanism for rotating the needle bar and the looper base about a e axis intersecting the X- and Y-axis directions; (f) a control device for controlling the driving mechanism, the feeding mechanism and the rotating mechanism, according to stitching data representative of a feeding movement of the feeding table and a rotating movement of the needle bar and the looper base, for each of the zigzag stitches in the foot portion and the eyelet-end portion of the eyelet-end buttonhole; (g) compensation data memory means storing a plurality of sets of compensation data for compensating the stitching data; (h) compensation data designating means for designating one of the plurality of sets of compensation data; and (i) compensating means for compensating the stitching data on the basis of the set of compensation data designated by the compensation data designating means.

In the buttonhole sewing machine of the present invention constructed as described above, the compensation data memory means stores two or more sets of compensation data for compensating the original stitching data. When one of these sets of compensation data is designated or selected by the compensation data designating means, the compensating means compensates or changes the original stitching data on the basis of the designated set of compensation data, so that the stitching positions actually formed according to the stitching data as compensated by the compensation data are suitably moved or offset so as to eliminate a deviation of the actually formed stitch pattern from the nominal stitch pattern, which deviation would occur depending upon the particular sewing condition such as the material and stretch property or elasticity of the work fabric and the tension of the sewing thread. Thus, the present buttonhole sewing machine is capable of stitching an eyelet-end buttonhole with high efficiency, so as to assure a neat stitch pattern appearance of the buttonhole.

In one preferred form of the buttonhole sewing machine of the present invention, the sets of compensation data stored in the compensation data memory means include at least one kind of compensation data selected from the group consisting of: X-axis compensation data for changing said inner and outer stitching positions of said zigzag stitches in said eyelet end portion in said X-axis direction; Y-axis compensation data for changing said inner and outer stitching positions of the zigzag stitches in said foot portion in said Y-axis direction; first θ-axis compensation data for changing said outer stitching positions of the zigzag stitches in said eyelet end portion in a direction of rotation about said 6 axis; and second θ-axis compensation data for changing said outer stitching positions of the zigzag stitches in said foot portion in said direction of rotation about said θ axis.

In this preferred form of the buttonhole sewing machine, the stitching data may be compensated on the basis of the compensation data suitably selected from the four kinds of compensation data, depending upon the portion of the buttonhole whose stitch pattern is to be compensated, and the direction in which the compensation should takes place. Namely, the stitching data for the eyelet end portion and the stitching data for the foot portion may be compensated independently of each other, if so desired. Further, the compensations of the stitching data in the X-axis, Y-axis and θ-axis directions may be effected independently of each other, if so desired. Thus, the present form of the buttonhole sewing machine has a comparatively high degree of freedom in compensating the stitching data depending upon the specific requirement.

In one advantageous arrangement of the above preferred form of the invention, each kind of compensation data includes a plurality of sets of compensation pattern data for compensating said stitching data, each set consisting of a plurality of sets of compensation values for appropriate stitches whose positions should be compensated.

In the above arrangement, the compensation data designating means may be adapted to designate one of the sets of compensation pattern data with a corresponding one of respective nominal compensating values which are assigned to the respective sets of compensation pattern data.

In another advantageous arrangement of the above preferred form of the invention, each of the above-indicated sets of compensation data stored in the compensation data memory means includes a plurality of kinds of compensation data selected from the above-indicated group consisting of the X-axis compensation data, Y-axis compensation data, first θ-axis compensation data and second θ-axis compensation data. This arrangement also has a high degree of freedom in compensating the stitching data.

In the above arrangement, each kind of compensation data may include a plurality of sets of compensation pattern data for compensating said stitching data. In this case, the compensation data designating means comprises compensation kind selecting means for selecting one of the kinds of compensation data, and data pattern selecting means for selecting one of the sets of compensation pattern data, for the kind of compensation data designated by the compensation kind selecting means.

In another preferred form of the buttonhole sewing machine of this invention, the plurality of sets of compensation data stored in the compensation data memory include at least one kind of compensation data selected from the group consisting of the X-axis compensation data for compensating the stitching data of the foot portion and the eyelet end portion in the X-axis direction, Y-axis compensation data for compensating the stitching data of the foot portion and the eyelet end portion in the Y-axis direction; and θ-axis compensation data for compensating the stitching data of the foot portion and the eyelet end portion in a direction of rotation about the θ axis. Further, each of the sets of compensation data includes a plurality of sets of compensation pattern data each of which consists of a plurality of sets of compensation values.

In a further preferred form of the present invention, the buttonhole sewing machine further comprises stitching data memory means for storing a plurality of sets of said stitching data for stitching respective different eyelet-end buttonholes, and stitching data selecting means for selecting one of the sets of stitching data. In this instance, the compensation data memory means stores a plurality of batches of compensation data in relation to the plurality of sets of the stitching data, respectively, each of the above-indicated batches of compensation data consisting of the plurality of sets of compensation data.

The first object indicated above may also be achieved according to a second aspect of this invention, which provides a buttonhole sewing machine for forming on a work fabric zigzag stitches defining an eyelet-end buttonhole including a foot portion and an eyelet end portion formed at one end of the foot portion, each of the zigzag stitches connecting an inner stitching position and an outer stitching position, the buttonhole sewing machine comprising: (a) stitch-forming instrumentalities including a sewing needle attached to a needle bar and, a looper device disposed in a looper base, the needle and the looper device cooperating to form the zigzag stitches; (b) a driving mechanism for operating the sewing needle and the looper device in synchronization with each other, to form the zigzag stitches successively; (c) a feeding table movable with the work fabric placed thereon, in a Y-axis direction parallel to a direction of extension of the foot portion from the eyelet end portion, and an X-axis direction perpendicular to the Y-axis direction; (d) a feeding mechanism for feeding the feeding table in the Y-axis and X-axis directions independently, when the sewing needle is placed above the work fabric; (e) a rotating mechanism for rotating the needle bar and the looper base about a e axis intersecting the X- and Y-axis directions; (f) a control device for controlling the driving mechanism, the feeding mechanism and the rotating mechanism, according to stitching data representative of a feeding movement of the feeding table and a rotating movement of the needle bar and the looper base, for each of the zigzag stitches in the foot portion and the eyelet-end portion of the eyelet-end buttonhole; (g) X-axis compensation data memory means storing a plurality of sets of X-axis compensation data for changing the inner and outer stitching positions of the zigzag stitches in the eyelet end portion in the X-axis direction; (h) X-axis compensation data designating means for designating one of the plurality of sets of X-axis compensation data; and (i) X-axis compensating means for retrieving from the X-axis compensation data memory means the set of X-axis compensation data designated by the X-axis compensation data designating means, and compensating the stitching data on the basis of the retrieved set of X-axis compensation data.

In the buttonhole sewing machine constructed according to the second aspect of this invention, one of the sets of X-axis compensation data stored in the X-axis compensation data memory is designated by the X-axis compensation data designating means, depending upon the particular sewing operation, and the stitching data are compensated on the basis of the designated set of X-axis compensation data, so that the inner and outer stitching positions of the zigzag stitches in the eyelet end portion of the eyelet-end buttonhole may be suitably moved or offset in the positive or negative X-axis direction, to eliminate a undesirable stitch pattern deviation of the stitched eyelet-end buttonhole.

In one advantageous arrangement of the above preferred form of the invention, the compensation data memory means further comprises Y-axis compensation data memory means storing a plurality of sets of Y-axis compensation data for changing the inner and outer stitching positions of the zigzag stitches in the foot portion in the Y-axis direction, and the compensation data designating means further comprises Y-axis compensation data designating means for designating one of the plurality of sets of Y-axis compensation data. In this case, the compensating means further comprises Y-axis compensating means for retrieving from the Y-axis compensation data memory means designated by the Y-axis compensation data designating means, and compensating the stitching data on the basis of the retrieved set of Y-axis compensation data. In this arrangement, the inner and outer stitching positions of the zigzag stitches in the foot portion of the eyelet-end buttonhole may be suitably moved or offset in the positive or negative Y-axis direction.

In another advantageous arrangement of the above preferred form of the present second aspect of the invention, the compensation data memory means further comprises first θ-axis compensation data memory means storing a plurality of sets of first θ-axis compensation data for changing the outer stitching positions of the zigzag stitches in the eyelet end portion in a direction of rotation about the θ axis, and the compensation data designating means further comprises first θ-axis compensation data designating means for designating one of the plurality of sets of first θ-axis compensation data. In this case, the compensating means further comprises first θ-axis compensating means for retrieving from the first θ-axis compensation data memory means designated by the first θ-axis compensation data designating means, and compensating the stitching data on the basis of the retrieved set of first θ-axis compensation data. In this arrangement, the outer stitching positions of the zigzag stitches in the eyelet end portion of the eyelet-end buttonhole may be suitably moved or offset clockwise or counterclockwise in the θ-axis direction.

In a further advantageous arrangement of Ache above preferred form of the buttonhole sewing machine, the compensation data memory means further comprises second θ-axis compensation data memory means storing a plurality of sets of second θ-axis compensation data for changing the outer stitching positions of the zigzag stitches in the foot portion in the direction of rotation about the θ axis, and the compensation data designating means further comprises second θ-axis compensation data designating means for designating one of the plurality of sets of second θ-axis compensation data. In this case, the compensating means further comprises second θ-axis compensating means for retrieving from the second θ-axis compensation data memory means designated by the second θ-axis compensation data designating means, and compensating the stitching data on the basis of the retrieved set of second θ-axis compensation data. In this arrangement, the outer stitching positions of the zigzag stitches in the foot portion of the eyelet-end buttonhole may be suitably moved or offset clockwise or counterclockwise in the θ-axis direction.

The second object indicated above may be achieved according to a third aspect of this invention, which provides a recording medium accessible by a computer of a sewing machine operated according to stitching data to form on a work fabric zigzag stitches defining an eyelet-end buttonhole including a foot portion and an eyelet end at one end of the foot portion, each of the zigzag stitches connecting an inner stitching position and an outer stitching position, the recording medium storing: a plurality of sets of compensation data for compensating the stitching data; and a control program executed by the computer for designating one of the plurality of sets of compensation data, and compensating the stitching data on the basis of the designated set of compensation data.

The above-indicated plurality of sets of compensation data stored in the recording medium may include at least one kind of compensation data selected from the group consisting of: X-axis compensation data for changing the inner and outer stitching positions of the zigzag stitches in the eyelet end portion in the X-axis direction; Y-axis compensation data for changing the inner and outer stitching positions of the zigzag stitches in the foot portion in the Y-axis direction; first θ-axis compensation data for changing the outer stitching positions of the zigzag stitches in the eyelet end portion in a direction of rotation perpendicular to the X-axis and Y-axis directions; and second θ-axis compensation data for changing the outer stitching positions of the zigzag stitches in the foot portion in the direction of rotation.

In the above case, the above-indicated at least one kind of compensation data may include a plurality of kinds of compensation data selected from the group, each of the plurality of kinds of compensation data including a plurality of sets of compensation pattern data for compensating the stitching data, each of the plurality of sets of compensation pattern data consisting of a plurality of sets of compensation values. In this instance, the control program may be formulated to include a routine for selecting one of the plurality of kinds of compensation data, and selecting one of the plurality of sets of compensation pattern data for the designated kind of compensation data.

BRIEF DESCRIPTION OF THE DRAWINGS

The above and optional objects, features, advantages and industrial and technical significance of the present invention will be better understood by reading the following detailed description of a presently preferred embodiment of the invention, when considered in connection with the accompanying drawings, in which:

FIG. 4 is a view for explaining standard stitching data for stitching an eyelet-end buttonhole on a work fabric;

FIG. 6 is a view for explaining X-axis compensation data stored in read-only memory of a control device of the control system of FIG. 5, for compensating the standard stitching data for changing the stitching positions in X-axis direction;

FIG. 7 is a view for explaining Y-axis compensation data stored in the read-only memory for compensating the standard stitching data for changing the stitching positions in Y-axis direction;

FIG. 8 is a view for explaining first θ-axis compensation data stored in the read-only memory for changing the stitching positions in eyelet end portion of the buttonhole in θ-axis direction;

FIG. 9 is a view for explaining second θ-axis compensation data stored in the read-only memory for changing the stitching positions in foot portion of the buttonhole in the θ-axis direction;

FIG. 13 is a view for explaining stitching data as compensated according to selected sets of compensation data.

DESCRIPTION OF THE PREFERRED EMBODIMENTS

Figure 1:
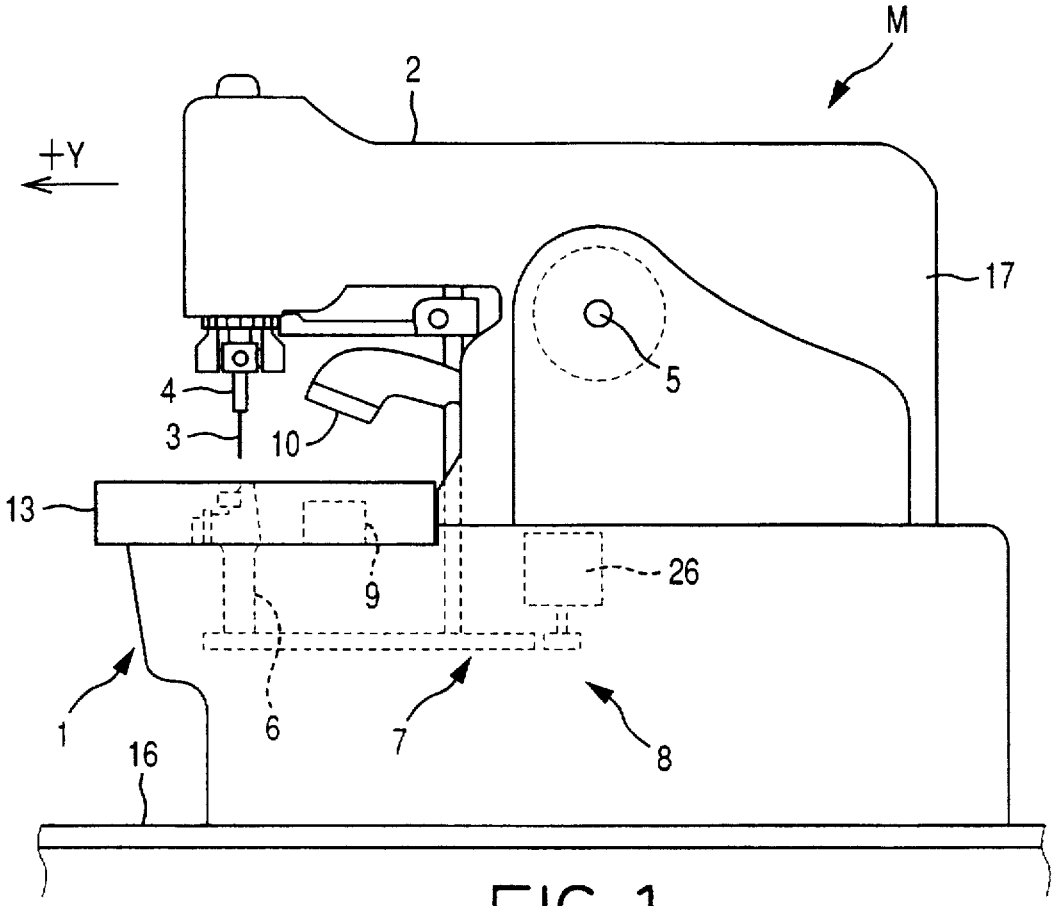
FIG. 1 is a side elevational view of an eyelet-end buttonhole sewing machine constructed according to one embodiment of this invention.

Referring first to FIG. 1, there will be described a buttonhole sewing machine M adapted to stitch an eyelet-end buttonhole or keyhole type buttonhole as indicated generally at DN in FIG. 5. The buttonhole sewing machine M includes a bed 1 having a substantially rectangular box construction, which rests on a machine base 16. On this bed 1, there is fixedly mounted a standard 17 which carries an integrally formed bracket arm 2. The bed 1 movably supports a feeding table 13 for feeding a work fabric. The bracket arm 2 extends over the feeding table 13, and supports a vertically reciprocable needle bar 4 to which a sewing needle 3 is attached.

As described below in detail, a looper base 6 is accommodated in the bed 1. The looper base 6 incorporates a looper device having two loopers 6a. The needle bar 4 (sewing needle 3) and the looper device (loopers **6*a*) constitute a major part of stitch-forming instrumentalities for forming zigzag stitches on the work fabric placed on the feeding table 13. As indicated by broken lines in FIG. 5, each zigzag stitch connects an inner stitching position and an outer stitching position. For instance, the second zigzag stitch 2N connects the inner stitching position <2> and the outer stitching position (2). In FIG. 5**, <N> represents the inner stitching position while (N) represents the outer stitching position.

Figure 3:
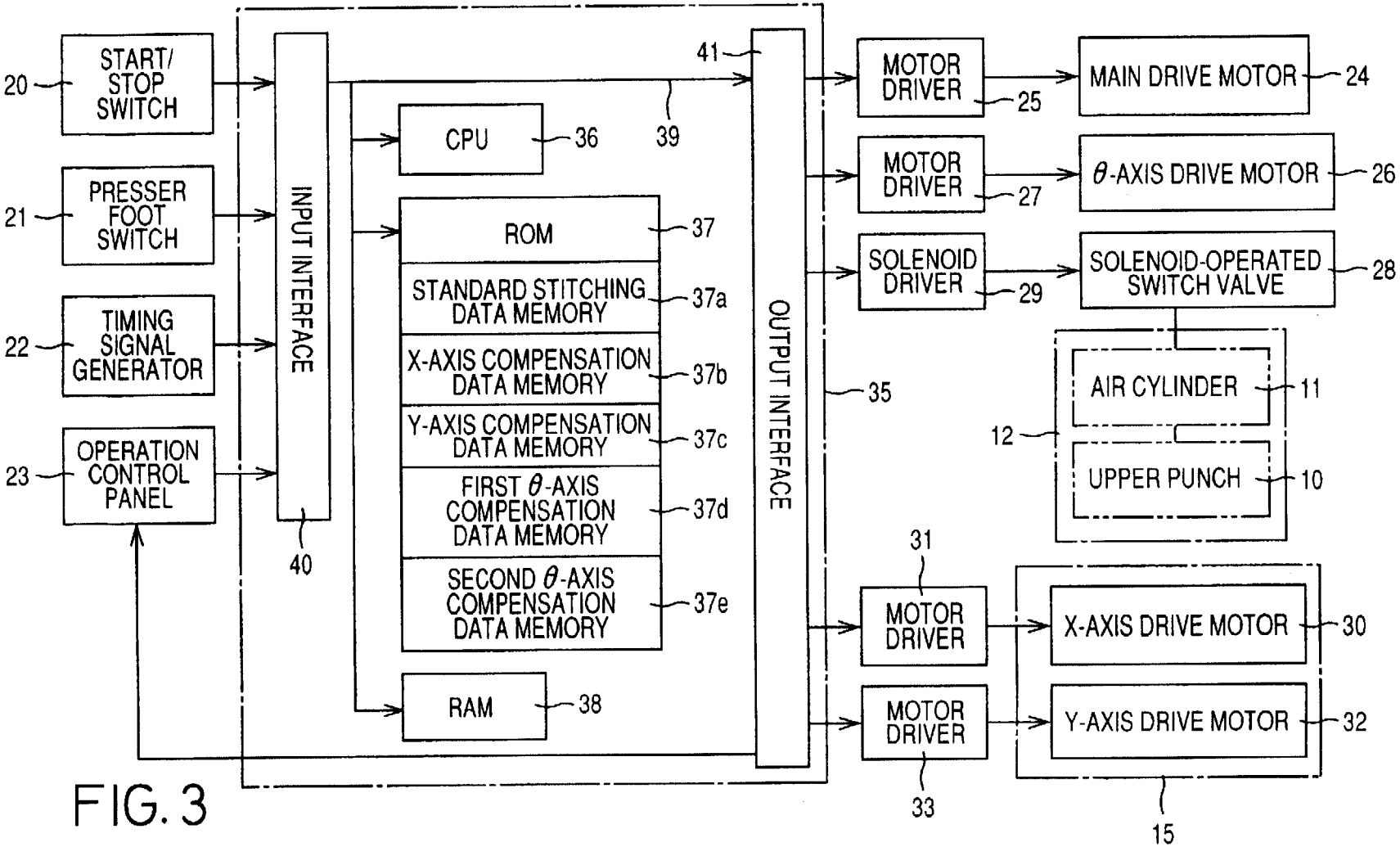
FIG. 3 is a block diagram illustrating a control system of the sewing machine of FIG. 1.

The needle bar 4 or sewing needle 3 and the looper device (loopers **6*a*) are operated by a driving mechanism, in synchronization with each other, to form the zigzag stitches successively. The driving mechanism includes a drive source in the form of a main drive motor 24 (FIG. 3) disposed in the machine base 16, and a main spindle 5 disposed in the standard 17. The machine base 16 carries an operation control panel 23 illustrated in FIG. 10, and a foot-operated START/STOP switch 20 and a presser foot switch 21, which are shown in FIG. 3. The machine base 16 further accommodates a control device 35 also shown in FIG. 3**, which is principally constituted by a microcomputer.

The needle bar 4 is vertically reciprocated with the sewing needle 3, by rotation of the main spindle 5 by the main drive motor 24. The rotary motion of the main spindle 5 is transferred to the needle bar 4 through a suitable cam mechanism as well known in the art. The needle bar 4 is adapted to be jogged laterally or sideways by a predetermined distance "L" by a suitable jogging mechanism, such that the lateral jogging movement of the needle bar 4 (sewing needle 3) is synchronized with the vertical reciprocating movement of the same. Described in detail, one full rotation or revolution of the main spindle 5 causes two reciprocating motions of the needle bar 4. The sewing needle 3 is lowered to an inner or left stitching position in the first reciprocating motion, and to an outer or right stitching position in the second reciprocating motion.

The looper base 6 incorporating the two loopers 6a (looper device) is disposed in the bed 1 such that the two loopers 6a are aligned with the inner and outer stitching positions of the sewing needle 3 indicated above. The rotary motion of the main spindle 5 which is transferred to the needle bar 4 through the cam mechanism is also transferred to the two loopers 6a through another cam mechanism, so that the loopers 6a are operated in synchronization with the vertical movement of the needle bar 4. The above-indicated driving mechanism for driving the stitch-forming instrumentalities (3, 4, 5, 6a) also includes the above-indicated cam mechanisms between the main spindle 5 and the needle bar 4 and the looper device (6a).

The needle bar 4 and the looper base 6 are rotated or pivoted as a unit about a vertical axis by a rotating mechanism 8, which includes a θ-axis drive motor 26 and a gear train 7. The θ-axis drive motor 26 is a stepping motor, a rotary motion of which is transferred to the needle bar 4 and the looper base 6 through the gear train 7. The vertical axis or θ-axis is perpendicular to X and Y axes along which the feeding table 13 are fed, as described below.

The bed 1 also accommodates a lower die 9 located behind the looper base 6. A upper punch 10 is disposed above this lower die 9, pivotally about a horizontal axis such that the upper punch 10 is moved toward and away from the lower die 9 upon pivotal movement of the upper punch 10 by an air cylinder 11 (FIG. 3) disposed in the bed 1. The upper punch 10 and the air cylinder 11 constitute a punch mechanism 12 (FIG. 3), which cooperates with the lower die 9 to constitute a cutter device for cutting an opening or aperture in the work fabric. This aperture consists of a generally elongate hole and an eyelet DH as indicated by two-dot chain line in FIG. 5. The elongate hole and the eyelet DH cooperate to form an eyelet-end buttonhole DN, which is worked with stitches. That is, the worked or stitched eyelet-end buttonhole DN includes a foot portion F consisting of a pair of side stitching parts FR, FL, and an eyelet end portion DE formed at one end of the foot portion F. The pair of side stitching parts FR, FL of the foot portion F are spaced apart from each other by the elongate hole, and are connected at their ends by the eyelet end portion DE which defines the eyelet DH. For convenience sake, "DN" represents either the eyelet-end buttonhole as an aperture consisting of the generally elongate hole and the eyelet DH, or the stitched or worked eyelet-end buttonhole whose periphery is defined by zigzag stitches in the foot portion F and the eyelet end portion DE.

Figure 2:
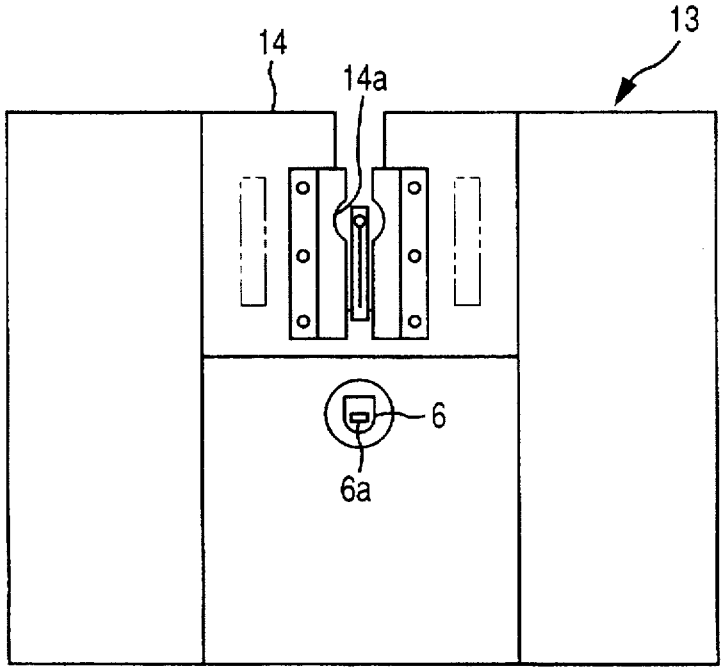
FIG. 2 is a fragmentary plan view of a feeding table of the sewing machine of FIG. 1.

The feeding table 13 movably supported on the bed 1 for feeding movements of the work fabric has a rectangular box construction having a relatively small height dimension. The feeding table 13 has a lower opening corresponding to the looper base 6, and an opening corresponding to the lower die 9. A part of the upper surface of the feeding table 13 is provided by a cloth plate 14 made of a metal and having an aperture 14a, as shown in FIG. 2. The feeding table 13 is fed along the mutually perpendicular X and Y axes (in the X-axis and Y-axis directions) by a feeding mechanism 15, which includes an X-axis drive motor 30 and a Y-axis drive motor 32, as indicated in FIG. 3. These drive motors 30, 32 are also stepping motors. The Y axis is parallel to the direction of extension of the pair of side stitching parts FR, FL of the foot portion F of the eyelet-end buttonhole DN, while the X axis is parallel to the direction in which the two side stitching parts FR, FL are spaced apart from each other, namely, perpendicular to the Y axis, as indicated in FIG. 5. As indicated above with respect to the rotating mechanism 8, the X and Y axes are perpendicular to the θ-axis about which the needle bar 4 and the looper base 6 are rotated by the θ-axis drive motor 26. The X-axis movement and the Y-axis movement of the feeding table 13 may be effected independently of each other. The cloth plate 14 is provided with two presser foot members (not shown) disposed on the right and left sides of the aperture 14a, for holding the work fabric on the feeding table 13.

Referring to the block diagram of FIG. 3, there will be described a control system for the present buttonhole sewing machine M.

The control system includes a control device 35 which incorporates a microcomputer including a central processing unit (CPU) 36, a read-only memory (ROM) 37 and a random-access memory (RAM) 38. The control device 35 further incorporates an input interface 40 and an output interface 41 which are connected to the microcomputer through a data bus 39. To the input interface 40, there are connected the above-indicated START/STOP switch 20, presser foot switch 21 and operation control panel 23, and a timing signal generator 22. The presser foot switch 21 generates a signal indicative of the operating position of the presser foot members indicated above. The timing signal generator 22 produces a SPINDLE PHASE signal indicative of the angular phase of the main spindle 5.

The control device 35 applies drive signals to driver circuits 25, 27, 29, 31 and 33 through the output interface 41. The driver circuit 25 is connected to the main drive motor 24 for operating the needle bar 4 and the looper device 6a. The driver circuit 27 is connected to the θ-axis motor 26 for rotating the needle bar 4 and the looper base 6. The driver circuit 29 is connected to a solenoid-operated switch valve 28 for controlling the air cylinder 11 to actuate the upper punch 10. The driver circuits 31 and 33 are connected to the X-axis drive motor 30 and the Y-axis drive motor 32, respectively. The output interface 41 is also connected to the operation control panel 23 for interactive communication between the control device 35 and the operation control panel 23.

Figure 12:
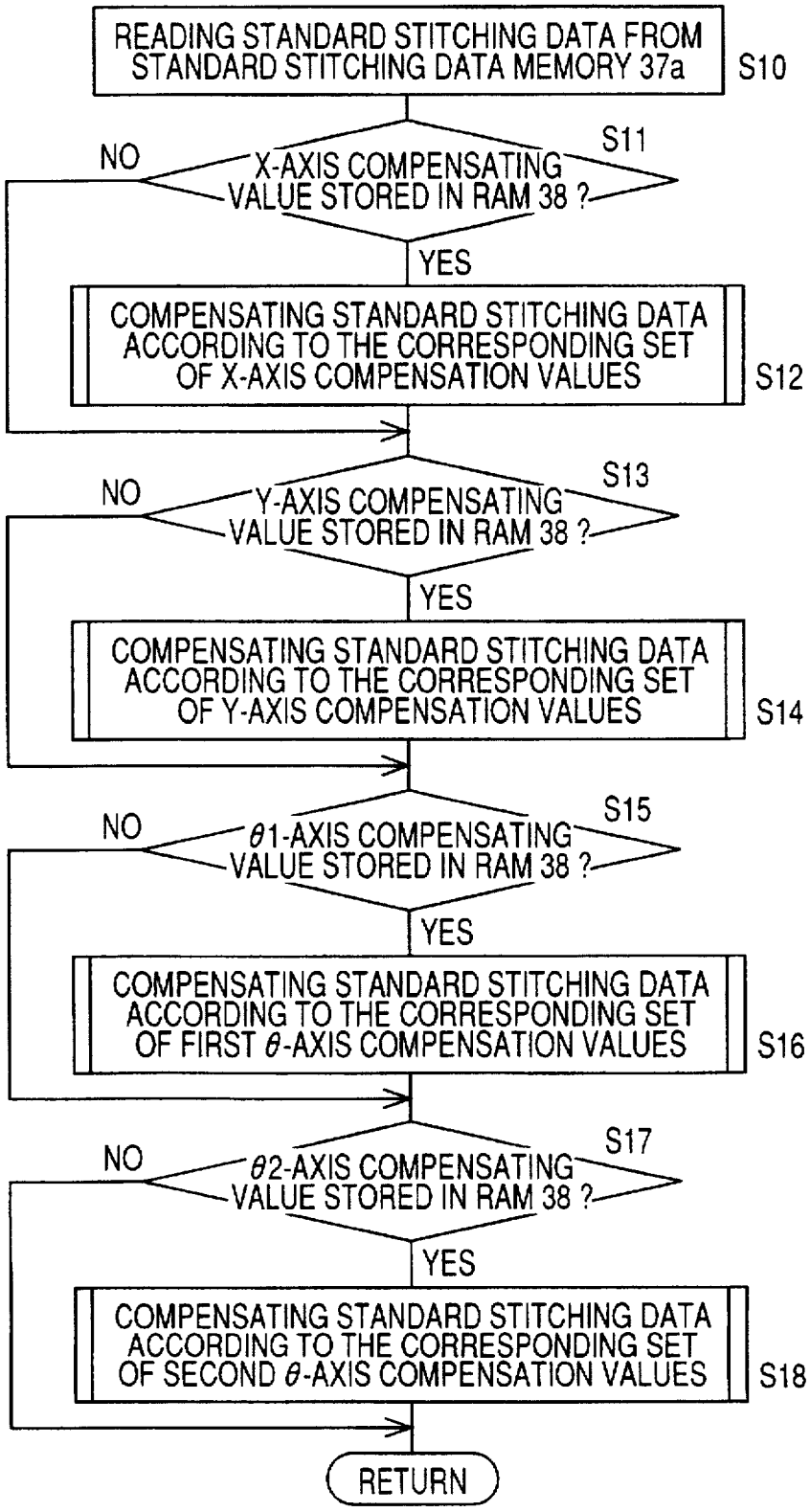
FIG. 12 is a flow chart illustrating a stitching data compensating routine executed according to a stitching data compensating control program stored in the read-only memory of the control device.

The ROM 37 stores a buttonhole stitching control program for executing an eyelet-end buttonhole stitching routine, and a stitching data compensating control program for executing a stitching data compensating routine illustrated in the flow chart of FIG. 12. The ROM 37 includes a standard stitching data memory 37a for storing a batch of standard or original stitching data consisting of two or more groups of standard stitching data representative of respective different eyelet-end buttonholes having different sizes. For instance, a group of standard stitching data represents a feeding movement of the feeding table 13 and a rotating movement of the needle bar 4 and looper base 6, for each of 16 zigzag stitches 1N through 16N which form the foot portion F and the eyelet end portion DE of the eyelet-end buttonhole DN, as shown in FIG. 5. The driving mechanism (5, 24), feeding mechanism (15) and rotating mechanism (8) are controlled according to the standard stitching data to stitch the foot and eyelet end portions F, DE of the eyelet-end buttonhole DN. Namely, the group of standard stitching data consists of 16 sets of data each set indicating the number of operating steps or pulses of the X-axis drive motor 30, the number of operating steps or pulses of the Y-axis drive motor 32, and the number of operating steps or pulses of the θ-axis drive motor 26, as indicated in FIG. 4.

Figure 5:
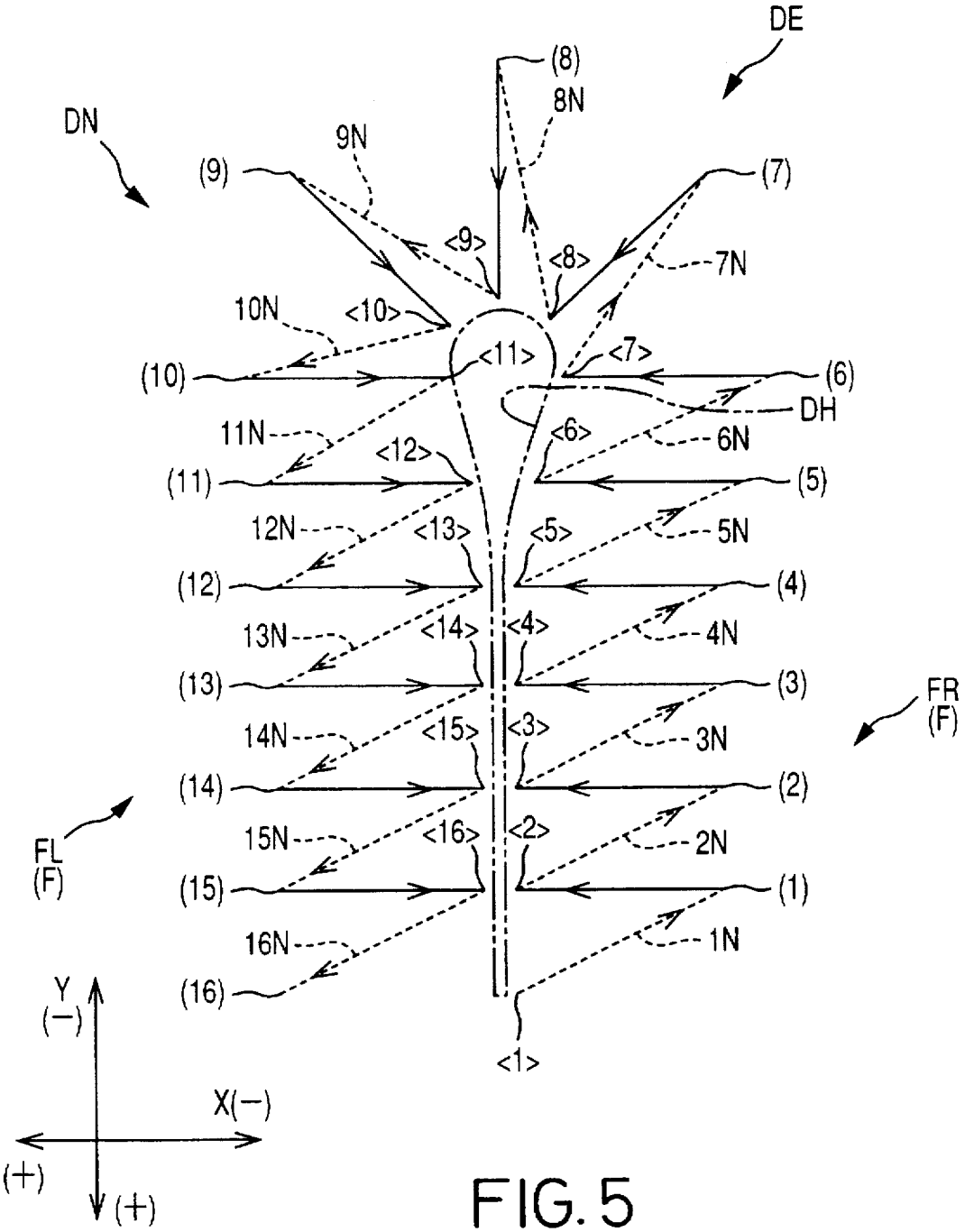
FIG. 5 is a view indicating nominal positions of stitches that should be formed to stitch the eyelet-end buttonhole on the work fabric.

In the example of FIGS. 4 and 5, the first through fourth sets of standard stitching data are formulated to form first through fourth zigzag stitches 1N–4N in the right side stitching part FR of the foot portion F of the eyelet-end buttonhole, as shown in FIG. 5, and the fifth through twelfth sets of original stitching data are formulated to form fifth through twelfth zigzag stitches 5N–12N in the eyelet end portion DE, as shown in FIG. 5. Further, the thirteenth through sixteenth sets of original stitching data are formulated to form thirteenth through sixteenth zigzag stitches 13N–16N in the left side stitching part FL of the foot portion F, as also shown in FIG. 5. In FIG. 5, the inner stitching position of each stitch N is indicated by <N>, while the outer stitching position is indicated by (N). In the coordinate system of FIG. 5, the leftward movement of the feeding table 13 (work fabric) is in the positive X-axis direction (+X), and the rightward movement is in the negative X-axis direction (–X). Similarly, the forward movement (downward movement as seen in FIG. 5) of the feeding table 13 (work fabric) is in the positive Y-direction (+Y), and the backward movement (upward movement as seen in FIG. 5) is in the negative Y-direction (–Y). The positive Y-axis direction (+Y) is indicated by arrow in FIG. 1.

The ROM 37 further includes an X-axis compensation data memory 37*b*, a Y-axis compensation data memory 37*c*, a first θ-axis compensation data memory 37*d* and a second θ-axis compensation data memory 37*e*, which store respective fourth different kinds of compensation data as indicated in FIGS. 6–9, respectively.

As indicated in FIG. 6, the X-axis compensation data memory 37*b* stores seven sets of compensation pattern data in the form of seven sets of X-axis compensation data for changing the inner and outer stitching positions of the zigzag stitches in the eyelet end portion DE of the eyelet-end buttonhole DN in the X-axis direction. The inner and outer stitching positions are the inner and outer positions at which the sewing needle 3 penetrates the work fabric to form the stitches. For example, each set of X-axis compensation data consists of six X-axis compensation values in the form of the numbers of operating steps or pulses of the X-axis drive motor 30. These six X-axis compensation values are for changing the outer stitching positions of the fifth, sixth, seventh, eleventh, twelfth and thirteenth zigzag stitches 5N–7N and 11N–13N in the X-axis direction. Of these zigzag stitches 5N–7N and 11N–13N, the stitches 5N–7N, 11N and 12N are in the eyelet end portion DE. Any positive X-axis compensation value stored in the X-axis compensation data memory 37*b* causes the feeding table 13 and the work fabric to be moved in the positive X-axis direction (leftward direction as seen in FIG. 5), whereby the appropriate outer stitching position is moved or offset in the negative X-axis direction, namely, in the rightward direction as seen in FIG. 5. Any negative X-axis compensation value causes the work fabric to be moved in the negative X--axis direction (rightward direction), whereby the appropriate stitching position is moved or offset in the negative X-axis direction, namely, in the rightward direction as seen in FIG. 5. To move the stitching position in the leftward direction, the work fabric should be moved in the rightward direction, and the X-axis compensation value should be negative.

The seven sets of X-axis compensation data stored in the X-axis compensation data memory 37*b* are identified by or designated with respective seven nominal compensating values "+3", "+2", "+1", "0", "–1", "–2" and "–3", as indicated in the uppermost row of the table in FIG. 6. When any set of X-axis compensation data identified by any one of the positive nominal compensating values "+3", "+2" and "+1" is designated, the outer stitching positions are generally moved in the positive X-axis direction, that is, in the leftward direction. When any set of X-axis compensation data identified by any one of the negative nominal compensating values "–1", "–2" and "–3" is designated, the outer stitching positions are generally moved in the negative X-axis direction, that is, in the rightward direction. When the set of X-axis compensation data identified by the nominal compensating value "0" is designated, the outer stitching positions are not moved in the X-axis direction. The seven sets of X-axis compensation data are formulated to eliminate a deviation of the actually formed stitch pattern from the nominal or desired stitch pattern, which deviation would occur depending upon the particular sewing condition such as the material and stretch property or elasticity of the work fabric and the tension of the sewing thread.

As indicated in FIG. 7, the Y-axis compensation data memory 37*c* stores seven sets of compensation pattern data in the form of seven sets of Y-axis compensation data for changing the inner and outer stitching positions of the zigzag stitches in the foot portion F of the eyelet-end buttonhole DN in the Y-Axis direction. For example, each set of Y-axis compensation data consists of three Y-axis compensation values in the form of the numbers of operating steps or pulses of the Y-axis drive motor 32. These three Y-axis compensation values are for changing the outer stitching positions of the thirteenth, fourteenth and fifteenth zigzag stitches 13N–15N of the left side stitching part FL of the foot portion F in the Y-axis direction. Any positive Y-axis compensation value stored in the Y-axis compensation data memory 37*c* causes causes the feeding table 13 and the work fabric to be moved in the positive Y-axis direction (forward direction, or downward direction as seen in FIG. 5), whereby the appropriate outer stitching position is moved or offset in the negative Y-axis direction, namely, in the backward direction or upward direction as seen in FIG. 5. Any negative Y-axis compensation value causes the work fabric to be moved in the negative Y-axis direction (backward direction, or upward direction as seen in FIG. 5), whereby the appropriate stitching position is moved or offset in the negative Y-axis direction, namely, in the forward or downward direction as seen in FIG. 5. To move the stitching position in the forward direction, the work fabric should be moved in the backward direction, and the Y-axis compensating value should be negative.

The seven sets of Y-axis compensation data stored in the Y-axis compensation data memory 37*c* are identified by or designated with respective seven nominal compensating values "+3", "+2", "+1", "0", "–1", "–2" and "–3", as indicated in the uppermost row in the table of FIG. 7. When any set of Y-axis compensation data identified by any one of the positive nominal compensating values "+3", "+2" and "+1" is designated, the outer stitching positions are generally moved in the backward direction. When any set of Y-axis compensation data identified by any one of the negative nominal compensating values "–1", "–2" and "–3" is designated, the outer stitching positions are generally moved in the forward direction. When the set of Y-axis compensation data identified by the nominal compensating value "0" is designated, the stitching positions are not moved in the Y-axis direction. These seven sets of Y-axis compensation data are also formulated to eliminate a deviation of the actually formed stitch pattern from the nominal or desired stitch pattern, which deviation would occur depending upon the particular sewing condition such as the material and stretch property of the work fabric and the tension of the sewing thread.

As indicated in FIG. 8, the first θ-axis compensation data memory 37*d* stores seven sets of compensation pattern data in the form of seven sets of first θ-axis compensation data for changing the inner and outer stitching positions of the zigzag stitches in the eyelet end portion DE of the eyelet-end buttonhole DN in the θ-Axis direction. For example, each set of first θ-axis compensation data consists of six first θ-axis compensation values in the form of the numbers of operating steps or pulses of the θ-axis drive motor 26 for changing the outer stitching positions of the fifth, sixth, seventh, eleventh, twelfth and thirteenth zigzag stitches 5N–7N and 13N–15N in the θ-axis direction. Of these stitches, the fifth, sixth, seventh, eleventh and twelfth stitches 5N–7N, 11N and 12N are in the eyelet end portion DE. Any positive first θ-axis compensation value stored in the first θ-axis compensation data memory 37*d* causes the needle bar 4 and the looper base 6 to be rotated in the positive θ-axis direction (counterclockwise direction), whereby the appropriate outer stitching position is moved or offset in the counterclockwise direction as seen in FIG. 5. Any negative first θ-axis compensation value causes the needle bar 4 and the looper base 6 to be rotated in the negative θ-axis direction (clockwise direction), whereby the appropriate stitching position is moved or offset in the clockwise direction as seen in FIG. 5.

The seven sets of first θ-axis compensation data stored in the first θ-axis compensation data memory 37*d* are identified by or designated with respective seven nominal compensating values "+3", "+2", "+1", "0", "−1", "−2" and "−3", as indicated in FIG. 8. When any set of first θ-axis compensation data identified by any one of the positive nominal compensating values "+3", "+2" and "+1" is designated, the outer stitching positions are generally moved in the counterclockwise direction. When any set of first θ-axis compensation data identified by any one of the negative nominal compensating values "−1", "−2" and "−3" is designated, the outer stitching positions are generally moved in the clockwise direction. When the set of first θ-axis compensation data identified by the nominal compensating value "0" is designated, the stitching positions are not moved in the θ-axis direction. These seven sets of first θ-axis compensation data are also formulated to eliminate a deviation of the actually formed stitch pattern from the nominal or desired stitch pattern, which deviation would occur depending upon the particular sewing condition such as the material and stretch property or elasticity of the work fabric and the tension of the sewing thread.

As indicated in FIG. 9, the second θ-axis compensation data memory 37*e* stores seven sets of compensation pattern data in the form of seven sets of second θ-axis compensation data for changing the inner and outer stitching positions of the zigzag stitches in the foot portion F of the eyelet-end buttonhole DN in the θ-Axis direction. For example, each set of second θ-axis compensation data consists of three second θ-axis compensation values in the form of the numbers of operating steps or pulses of the θ-axis drive motor 26 for changing the outer stitching positions of the first, fifth and thirteenth zigzag stitches 1N, 5N and 13N in the θ-axis direction. Of these stitches, the first stitch 1N is in the right side stitching part FR while the thirteenth stitch 13N is in the left side stitching part FL. The compensation value for the fifth stitch 5N is provided to prevent the eyelet end portion DE from being influenced by the compensation values for the first and thirteenth stitches 1N, 13N. Any positive second θ-axis compensation value stored in the second θ-axis compensation data memory 37*e* causes the needle bar 4 and the looper base 6 to be rotated in the positive θ-axis direction, namely, in the counterclockwise direction, whereby the appropriate outer stitching position is moved or offset in the counterclockwise direction as seen in FIG. 5. Any negative second θ-axis compensation value causes the needle bar 4 and the looper base 6 to be rotated in the negative θ-axis direction, namely, in the clockwise direction, whereby the appropriate stitching position is moved or offset in the clockwise direction as seen in FIG. 5.

The seven sets of second θ-axis compensation data stored in the second θ-axis compensation data memory 37*e* are identified by or designated with respective seven nominal compensating values "+3", "+2", "+1", "0", "−1", "−2" and "−3", as indicated in FIG. 9. When any set of second θ-axis compensation data identified by any one of the positive nominal compensating values "+3", "+2" and "+1" is designated, the outer stitching positions are generally moved in the counterclockwise direction. When any set of second θ-axis compensation data identified by any one of the negative nominal compensating values "−1", "−2" and "3" is designated, the outer stitching positions are generally moved in the clockwise direction. When the set of first θ-axis compensation data identified by the nominal compensating value "0" is designated, the stitching positions are not moved in the θ-axis direction. These seven sets of second θ-axis compensation data are also formulated to eliminate a deviation of the actually formed stitch pattern from the nominal or desired stitch pattern, which deviation would occur depending upon the particular sewing condition such as the material and stretch property or elasticity of the work fabric and the tension of the sewing thread.

Figure 10:
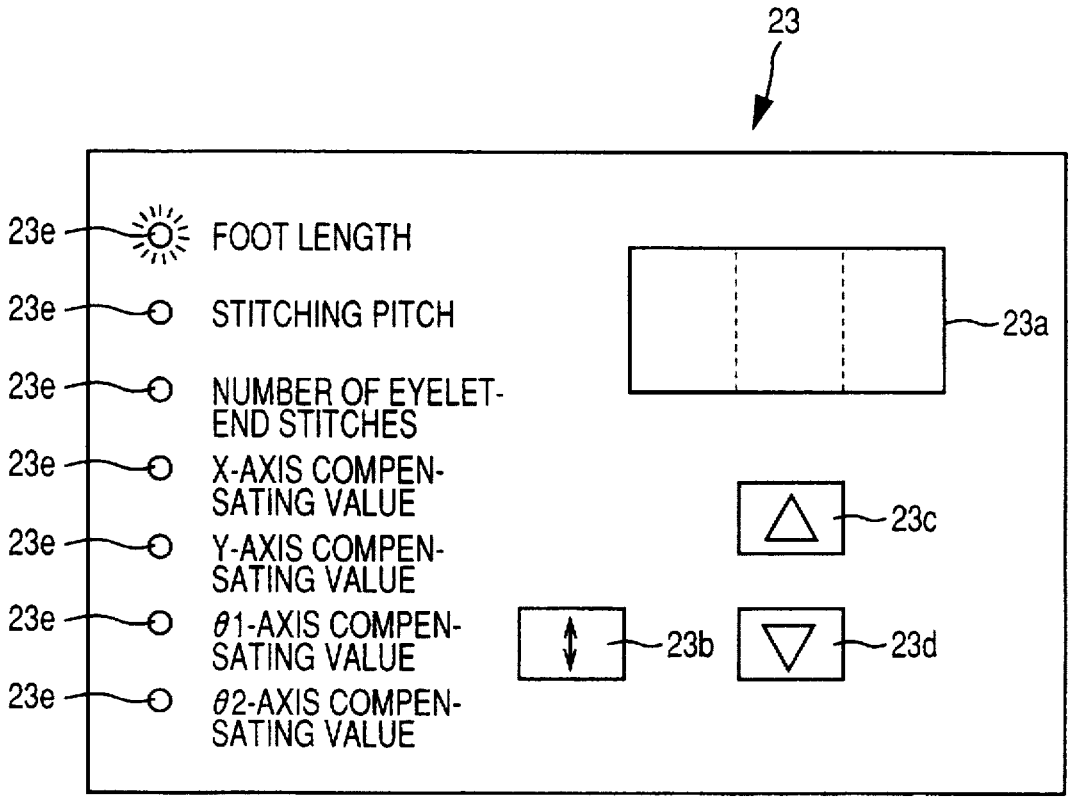
FIG. 10 is a plan view of an operation control panel of the buttonhole sewing machine.

On the operation control panel 23, there are provided an array of seven legends: FOOT LENGTH; STITCHING PITCH; NUMBER OF EYELET-END STITCHES; X-AXIS COMPENSATING VALUE; Y-AXIS COMPENSATING VALUE; θ1-AXIS COMPENSATING VALUE; and θ2-AXIS COMPENSATING VALUE, as indicated in FIG. 10. These legends have the following meanings:

FOOT LENGTH:

Length of the foot portion F in the Y-axis direction

STITCHING PITCH:

Stitching pitch of the foot portion F in the Y-axis direction

NUMBER OF EYELET-END STITCHES:

Number of stitches in the eyelet end portion DE X-AXIS COMPENSATING VALUE:

Nominal compensating value identifying one of seven sets of X-axis compensation values in FIG. 6

Y-AXIS COMPENSATION VALUE:

Nominal compensating value identifying one of seven sets of Y-axis compensation values in FIG. 7

θ1-AXIS COMPENSATING VALUE:

Nominal compensating value identifying one of seven sets of first θ-axis compensation values in FIG. 8

θ2-AXIS COMPENSATION VALUE:

Nominal compensating value identifying one of seven sets of second θ-axis compensation values in FIG. 9 The operation panel 23 provides a 3-digit LED display 23*a*, a selector key 23*b*, an increment key 23*c*, a decrement key 23*d* and indicator lights 23*e*. The indicator lights 23*e* are provided for respective items indicated by the seven legends explained above. In the example of FIG. 10, the indicator light 23*e* adjacent to the legend FOOT LENGTH is illuminated, indicating that the length of the foot portion F of the eyelet-end buttonhole DN can be specified or entered by using the increment and decrement keys 23*c*, 23*d*. That is, a numerical value displayed on the display 23*a* can be incremented or decremented by the increment or decrement key 23*c*, 23*d*. Each time the selector key 23*b* is pressed, the item that can be specified or entered by the operator is changed, with the corresponding indicator light 23e being illuminated. The items FOOT LENGTH, STITCHING PITCH and NUMBER OF EYELET-END STITCHES are selected to select one of the groups of standard stitching data stored in the standard stitching data memory 37a.

The items X-AXIS COMPENSATING VALUE, Y-AXIS COMPENSATING VALUE, θ1-AXIS COMPENSATING VALUE and θ2-AXIS COMPENSATING VALUE are selected as needed to compensate the standard or original stitching data for changing the stitching positions in the X-axis, Y-axis and θ-axis directions. More specifically described, the selector key 23b and the increment and decrement keys 23c, 23d are operated as needed by the operator to designate one of the seven sets of X-axis compensation values stored in the X-axis compensation data memory 37b, one of the seven sets of Y-axis compensation values stored in the Y-axis compensation data memory 37c, one of the seven sets of first θ-axis compensation values stored in the first θ-axis compensation data memory 37d, and one of the seven sets of second θ-axis compensation values stored in the second θ-axis compensation data memory 37e.

Figure 11:
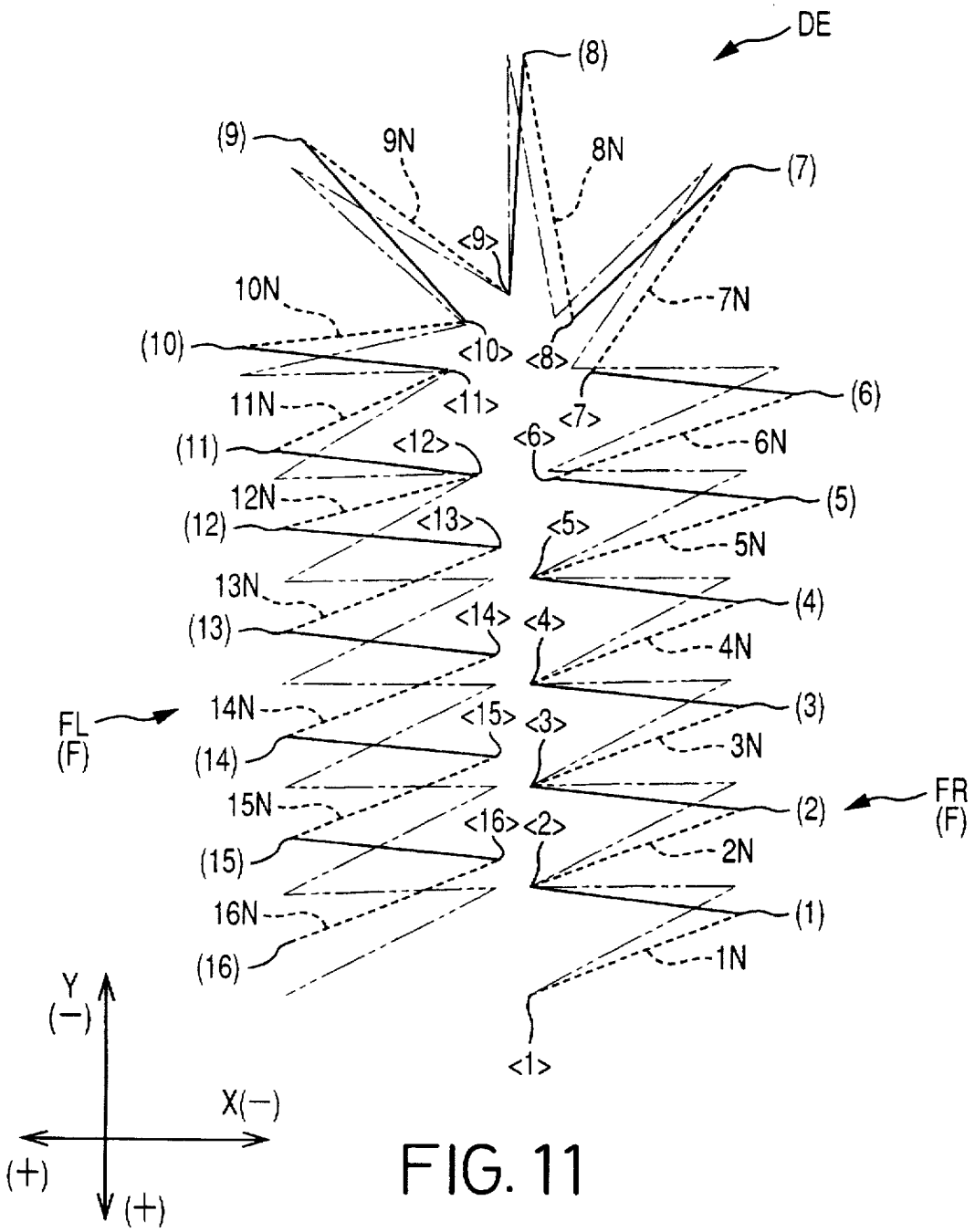
FIG. 11 is a view corresponding to that of FIG. 5, showing deviation of the stitching positions from the nominal positions.

Referring to FIG. 11, an ideal or nominal stitch pattern of an eyelet-end buttonhole is shown by two-dot chain lines. Generally, however, the stitching positions of the zigzag stitches 1N–16N tend to deviate from the ideal stitch pattern, as indicated by solid and broken lines in FIG. 11 by way of example, depending upon the specific properties of the work fabric. In the example of FIG. 11, the stitch pattern indicated by the solid and broken lines suffer from the following deviations of the zigzag stitches:

1) Deviation of the inner and outer stitching positions in the eyelet end portion DE in the rightward or negative X axis direction;
2) Deviation of the inner and outer stitching positions in the left side stitching part FR of the foot portion F in the backward or negative Y-axis direction;
3) Deviation of the outer stitching positions in the eyelet end portion DE in the clockwise or negative θ-axis direction; and
4) Deviation of the outer stitching positions in the foot portion F in the clockwise or negative θ-axis direction.

In the light of the above tendency of deviation, the X-axis compensation data of FIG. 6, Y-axis compensation data of FIG. 7, first θ-axis compensation data of FIG. 8 and second θ-axis compensation data of FIG. 9 are formulated to eliminate the above deviations and are stored in the respective compensation data memories 37b–37e. To eliminate the deviations, the operator designates one of the seven sets of compensation data stored in each of the compensation data memories 37b–37e, prior to a buttonhole stitching operation, depending upon the degrees of deviations of the stitch pattern of the buttonhole which has been actually formed in a trial buttonhole stitching operation according to the standard or original stitching data stored in the standard stitching data memory 37a.

For instance, the operator designates the set of X-axis compensation values by entering numerical value "+2" by operating the selector key 23b and increment or decrement key 23c, 23d. Namely, the operator selects enters the nominal compensating value "+2" to designate the corresponding set of X-axis compensation values. Similarly, the operator enters the nominal compensating value "−2" to designate the corresponding set of Y-axis compensation values. Further, the operator enters the nominal compensating value "+3" to designate the corresponding sets of first and second θ-axis compensation values. The thus entered nominal compensating values for the X-axis, Y-axis and first and second θ-axis compensation values are stored in the RAM 38.

Then, the operator turns on the START/STOP switch 20 to initiate the stitching data compensating routine of FIG. 12 prior to the eyelet-end buttonhole stitching routine (not shown).

The stitching data compensating routine illustrated in the flow chart of FIG. 12 is executed according to the stitching data compensating control program stored in the ROM 37. This stitching data compensating routine is initiated with step S10 in which the standard stitching data are read from the standard stitching data memory 37a of the ROM 37. Step S10 is followed by step S11 to determine whether any nominal X-axis compensating value is stored in the RAM 38. If an affirmative decision (YES) is obtained in step S11, the control flow goes to step S12 in which the standard stitching data are compensated according to the set of X-axis compensation values which is designated by the nominal X-axis compensating value stored in the RAM 38 and which is stored in the X-axis compensation data memory 37b.

Then, the control flow goes to step S13 to determine whether any nominal Y-axis compensating value is stored in the RAM 38. If an affirmative decision (YES) is obtained in step S13, the control flow goes to step S14 in which the standard stitching data are compensated according to the set of Y-axis compensation values which is designated by the nominal Y-axis compensating value stored in the RAM 38 and which is stored in the Y-axis compensation data memory 37c.

Step S14 is followed by step S15 to determine whether any nominal first θ-axis compensating value is stored in the RAM 38. If an affirmative decision (YES) is obtained in step S15, the control flow goes to step S16 in which the standard stitching data are compensated according to the set of first θ-axis compensation values which is designated by the nominal first θ-axis compensating value stored in the RAM 38 and which is stored in the first θ-axis compensation data memory 37d.

Then, the control flow goes to step S17 to determine whether any nominal second θ-axis compensating value is stored in the RAM 38. If an affirmative decision (YES) is obtained in step S17, the control flow goes to step S18 in which the standard stitching data are compensated according to the set of second θ-axis compensation values which is designated by the nominal second θ-axis compensating value stored in the RAM 38 and which is stored in the second θ-axis compensation data memory 37e.

After completion of the stitching data compensating routine of FIG. 12, the buttonhole stitching routine is executed to form the zigzag stitches for stitching the eyelet-end buttonhole DN according to the standard stitching data as compensated by the sets of compensation values in the stitching data compensating routine of FIG. 12.

Figure 14:
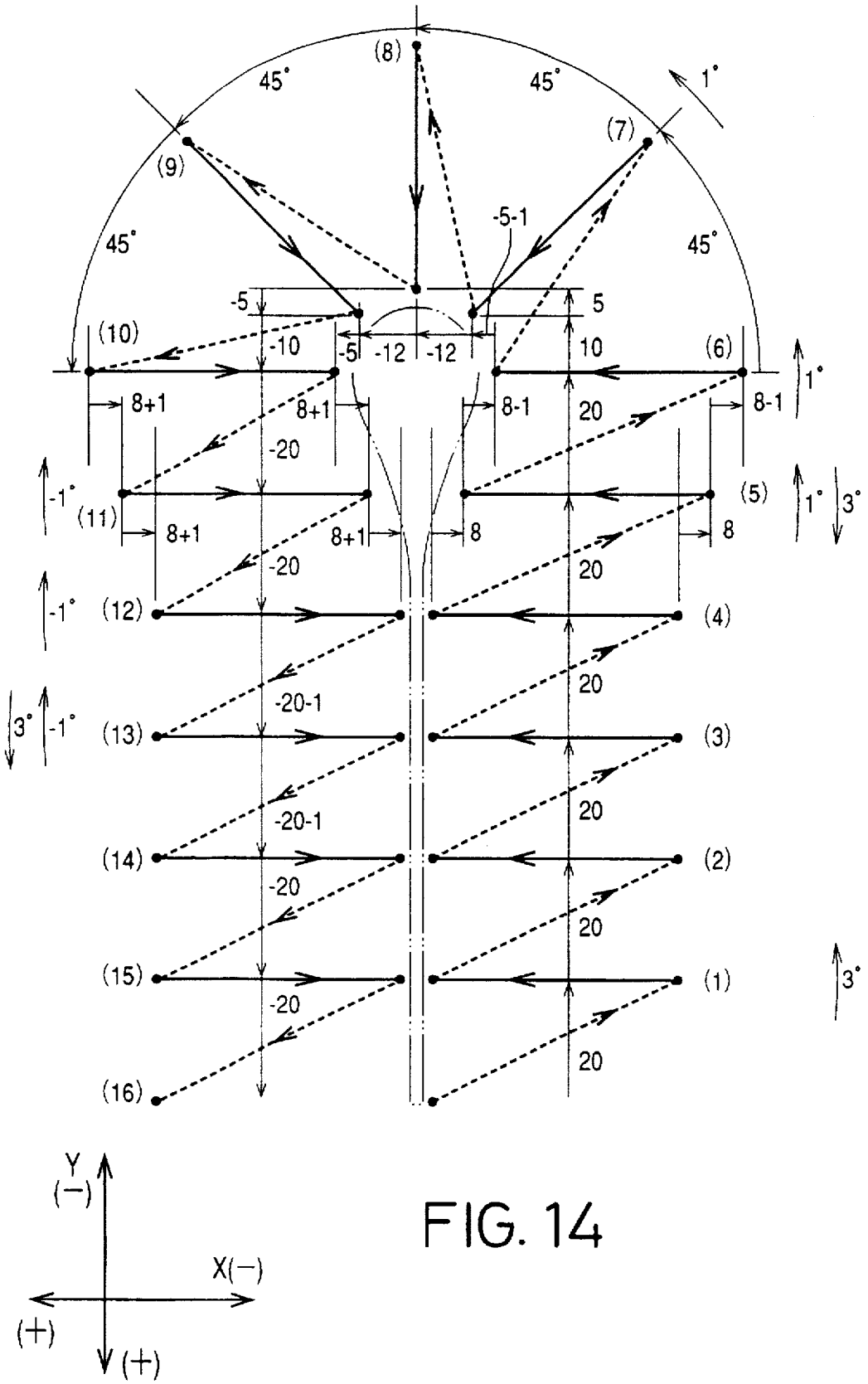
FIG. 14 is a view for explaining compensation of the stitching positions according to the selected sets of compensation data.

When the nominal X-axis compensating value "+2", nominal Y-axis compensating value "−2", nominal first θ-axis compensating value "+3" and nominal second θ-axis compensating value "+3" are entered through the operation control panel 23, as described above by way of example, the standard stitching data of FIG. 4 are compensated into compensated stitching data as indicated in FIG. 13. When the buttonhole stitching operation is performed according to this compensating stitch data of FIG. 13, the eyelet-end buttonhole is stitched as indicated in FIG. 14, which shows the compensation of various stitching positions in the X-axis, Y-axis and θ-axis directions according to the designated sets of compensation values. It will be understood that the stitch pattern deviations 1) through 4) indicated above are eliminated by compensation of the standard stitching data according to the designated sets of compensation values. In FIG. 14, the clockwise and counterclockwise rotations by the θ-axis compensation data are indicated by degrees of angle, since one operating step or pulse of the θ-axis drive motor 26 is equivalent to rotation by one degree of angle.

In the eyelet-end buttonhole sewing machine constructed according to the present embodiment of the invention described above, a desired one of the sets of compensation values stored in each of the X-axis, Y-axis, first θ-axis and second θ-axis compensation data memories **37*b*–37*e* is designated by the operator by manipulating the operation control panel 23**, so that the deviations of the stitch pattern in the different parts of the eyelet-end buttonhole are eliminated by compensation of the standard stitching data according to the designated sets of compensation values. More specifically, the inner and outer stitching positions of the zigzag stitches in the eyelet end portion DE are changed in the positive or negative X-direction, and the inner and outer stitching positions of the zigzag stitches in the foot portion F are changed in the positive or negative Y-axis direction. Further, the outer stitching positions of the zigzag stitches in the eyelet end portion DE and the foot portion F are changed in the positive or negative θ-axis direction.

The present buttonhole sewing machine M is characterized by the provision of the X-axis compensation data memory **37*b*, Y-axis compensation data memory 37*c*, first θ-axis compensation data memory 37*d* and second θ-axis compensation data memory 37*e*, which store respectively the X-axis compensation data, Y-axis compensation data, first θ-axis compensation data and second θ-axis compensation data that are formulated so as to eliminate deviations of the stitch pattern which would occur depending upon the specific sewing condition as defined by the material and stretch property or elasticity of the work fabric and the tension of the sewing thread. The operator designates one of the sets of compensation values stored in each of the compensation data memories 37*b*–37*e*, depending upon the deviations of the stitch pattern actually formed on the work fabric in a test sewing operation. This simple designation of the appropriate sets of compensation data through the operation control panel 23** permits the eyelet-end buttonhole to be stitched with a neat pleasant stitch pattern appearance, yet with improved stitching efficiency. Since there are available four different kinds of compensation data in the form of the X-axis, Y-axis, first θ-axis and second θ-axis compensation data, the stitching positions in the foot portion F and the eyelet end portion DE can be compensated independently of each other, in the desired directions.

While the present invention has been described above in detail in its presently preferred embodiment, it is to be understood that the present invention is not limited to the details of the illustrated embodiment, but may be embodied with various changes, modifications, and improvements, which may occur to those skilled in the art, in the light of the foregoing teachings, without departing from the spirit and scope of the invention defined in the appended claims.

In the illustrated embodiment, each of the compensation data memories **37*b*–37*e* stores only one batch of compensation data which is used for all of the different eyelet-end buttonholes whose standard stitching data are stored in the standard stitching data memory 37*a*. However, each of the compensation data memories 37*b*–37*e*** may store two or more batches of compensation data which are selectively used depending upon the selected one of the buttonholes to be stitched.

While the four kinds of compensation data are stored in the respective memories **37*b*–37*e*** and used in combination, two or three kinds of compensation data may be used in combination.

What is claimed is:

1. A buttonhole sewing machine for forming on a work fabric zigzag stitches defining an eyelet-end buttonhole including a foot portion and an eyelet end portion formed at one end of said foot portion, each of said zigzag stitches connecting an inner stitching position and an outer stitching position, said buttonhole sewing machine comprising:

stitch-forming instrumentalities including a sewing needle attached to a needle bar and, a looper device disposed in a looper base, said needle and said looper device cooperating to form said zigzag stitches;

a driving mechanism for operating said sewing needle and said looper device in synchronization with each other, to form said zigzag stitches successively;

a feeding table movable with said work fabric placed thereon, in a Y-axis direction parallel to a direction of extension of said foot portion from said eyelet end portion, and an X-axis direction perpendicular to said Y-axis direction;

a feeding mechanism for feeding said feeding table in said Y-axis and X-axis directions independently, when said sewing needle is placed above said work fabric;

a rotating mechanism for rotating said needle bar and said looper base about a θ axis intersecting said X- and Y-axis directions;

a control device for controlling said driving mechanism, said feeding mechanism and said rotating mechanism, according to stitching data representative of a feeding movement of said feeding table and a rotating movement of said needle bar and said looper base, for each of said zigzag stitches in said foot portion and said eyelet-end portion of said eyelet-end buttonhole;

compensation data memory means storing a plurality of sets of compensation data for compensating said stitching data;

compensation data designating means for designating one of said plurality of sets of compensation data; and compensating means for compensating said stitching data on the basis of the set of compensation data designated by said compensation data designating means.

2. A buttonhole sewing machine according to claim 1, wherein said plurality of sets of compensation data include at least one kind of compensation data selected from the group consisting of: X-axis compensation data for changing said inner and outer stitching positions of said zigzag stitches in said eyelet end portion in said X-axis direction; Y-axis compensation data for changing said inner and outer stitching positions of the zigzag stitches in said foot portion in said Y-axis direction; first θ-axis compensation data for changing said outer stitching positions of the zigzag stitches in said eyelet end portion in a direction of rotation about said θ axis; and second θ-axis compensation data for changing said outer stitching positions of the zigzag stitches in said foot portion in said direction of rotation about said θ axis.

3. A buttonhole sewing machine according to claim 2, wherein each of said at least one kind of compensation data includes a plurality of sets of compensation pattern data for compensating said stitching data, each of said plurality of sets of compensation pattern data consisting of a plurality of sets of compensation values.

4. A buttonhole sewing machine according to claim 3, wherein said compensation data designating means designates one of said plurality of sets of compensation pattern data with a corresponding one of respective nominal compensating values which are assigned to said plurality of sets of compensation pattern data, respectively.

5. A buttonhole sewing machine according to claim 2, wherein said each of said plurality of sets of compensation data includes a plurality of kinds of compensation data selected from said group.

6. A buttonhole sewing machine according to claim 5, wherein each of said plurality of kinds of compensation data includes a plurality of sets of compensation pattern data for compensating said stitching data, and said compensation data designating means comprises compensation kind selecting means for selecting one of said plurality of kinds of compensation data, and data pattern selecting means for selecting one of said plurality of sets of compensation pattern data, for the kind of compensation data designated by said compensation kind selecting means.

7. A buttonhole sewing machine according to claim 1, wherein said plurality of sets of compensation data include at least one kind of compensation data selected from the group consisting of: X-axis compensation data for compensating the stitching data of said foot portion and said eyelet end portion in said X-axis direction; Y-axis compensation data for compensating the stitching data of said foot portion and said eyelet end portion in said Y-axis direction; and θ-axis compensation data for compensating the stitching data of said foot portion and said eyelet end portion in a direction of rotation about said θ axis, and wherein each of said plurality of sets of compensation data includes a plurality of sets of compensation pattern data each of which consists of a plurality of sets of compensation values.

8. A buttonhole sewing machine according to claim 1, further comprising stitching data memory means for storing a plurality of sets of said stitching data for stitching respective different eyelet-end buttonholes, and stitching data selecting means for selecting one of said plurality of sets of said stitching data, and wherein said compensation data memory means stores a plurality of batches of compensation data in relation to said plurality of sets of said stitching data, respectively, each of said batches of compensation data consisting of said plurality of sets of compensation data.

9. A buttonhole sewing machine for forming on a work fabric zigzag stitches defining an eyelet-end buttonhole including a foot portion and an eyelet end portion formed at one end of said foot portion, each of said zigzag stitches connecting an inner stitching position and an outer stitching position, said buttonhole sewing machine comprising:

stitch-forming instrumentalities including a sewing needle attached to a needle bar and, a looper device disposed in a looper base, said needle and said looper device cooperating to form said zigzag stitches;

a driving mechanism for operating said sewing needle and said looper device in synchronization with each other, to form said zigzag stitches successively;

a feeding table movable with said work fabric placed thereon, in a Y-axis direction parallel to a direction of extension of said foot portion from said eyelet end portion, and an X-axis direction perpendicular to said Y-axis direction;

a feeding mechanism for feeding said feeding table in said Y-axis and X-axis directions independently, when said sewing needle is placed above said work fabric;

a rotating mechanism for rotating said needle bar and said looper base about a θ axis intersecting said X- and Y-axis directions;

a control device for controlling said driving mechanism, said feeding mechanism and said rotating mechanism, according to stitching data representative of a feeding movement of said feeding table and a rotating movement of said needle bar and said looper base, for each of said zigzag stitches in said foot portion and said eyelet-end portion of said eyelet-end buttonhole;

X-axis compensation data memory means storing a plurality of sets of X-axis compensation data for changing said inner and outer stitching positions of said zigzag stitches in said eyelet end portion in said X-axis direction;

X-axis compensation data designating means for designating one of said plurality of sets of X-axis compensation data; and X-axis compensating means for retrieving from said X-axis compensation data memory means the set of X-axis compensation data designated by said X-axis compensation data designating means, and compensating said stitching data on the basis of the retrieved set of X-axis compensation data.

10. A buttonhole sewing machine according to claim 9, wherein said compensation data memory means further comprises Y-axis compensation data memory means storing a plurality of sets of Y-axis compensation data for changing said inner and outer stitching positions of said zigzag stitches in said foot portion in said Y-axis direction, and said compensation data designating means further comprises Y-axis compensation data designating means for designating one of said plurality of sets of Y-axis compensation data, and wherein said compensating means further comprises Y-axis compensating means for retrieving from said Y-axis compensation data memory means designated by said Y-axis compensation data designating means, and compensating said stitching data on the basis of the retrieved set of Y-axis compensation data.

11. A buttonhole sewing machine according to claim 9, wherein said compensation data memory means further comprises first θ-axis compensation data memory means storing a plurality of sets of first θ-axis compensation data for changing said outer stitching positions of said zigzag stitches in said eyelet end portion in a direction of rotation about said θ axis, and said compensation data designating means further comprises first θ-axis compensation data designating means for designating one of said plurality of sets of first θ-axis compensation data, and wherein said compensating means further comprises first θ-axis compensating means for retrieving from said first θ-axis compensation data memory means designated by said first θ-axis compensation data designating means, and compensating said stitching data on the basis of the retrieved set of first θ-axis compensation data.

12. A buttonhole sewing machine according to claim 9, wherein said compensation data memory means further comprises second θ-axis compensation data memory means storing a plurality of sets of second θ-axis compensation data for changing said outer stitching positions of said zigzag stitches in said foot portion in said direction of rotation about said θ axis, and said compensation data designating means further comprises second θ-axis compensation data designating means for designating one of said plurality of sets of second θ-axis compensation data, and wherein said compensating means further comprises second θ-axis compensating means for retrieving from said second θ-axis compensation data memory means designated by said second θ-axis compensation data designating means, and compensating said stitching data on the basis of the retrieved set of second θ-axis compensation data.

13. A recording medium accessible by a computer of a sewing machine operated according to stitching data to form on a work fabric zigzag stitches defining an eyelet-end buttonhole including a foot portion and an eyelet end portion at one end of said foot portion, said stitching data representing a nominal inner stitching position and a nominal outer stitching position of each of said zigzag stitches, said recording medium storing:

a plurality of sets of compensation data each for compensating said stitching data so that actual inner and outer stitching positions of said zigzag stitches formed on said work fabric coincide with said nominal inner and outer stitching positions; and a control program executed by said computer for designating one of said plurality of sets of compensation data, and compensating said stitching data on the basis of the designated set of compensation data.

14. A recording medium according to claim 13, wherein said plurality of sets of compensation data include at least one kind of compensation data selected from the group consisting of: X-axis compensation data for changing said nominal inner and outer stitching positions of said zigzag stitches in said eyelet end portion in said X-axis direction; Y-axis compensation data for changing said nominal inner and outer stitching positions of the zigzag stitches in said foot portion in said Y-axis direction; first θ-axis compensation data for changing said nominal outer stitching positions of the zigzag stitches in said eyelet end portion in a direction of rotation perpendicular to said X-axis and Y-axis directions; and second θ-axis compensation data for changing said nominal outer stitching positions of the zigzag stitches in said foot portion in said direction of rotation.

15. A buttonhole sewing machine according to claim 14, wherein said at least one kind of compensation data includes a plurality of kinds of compensation data selected from said group, each of said plurality of kinds of compensation data including a plurality of sets of compensation pattern data for compensating said stitching data, each of said plurality of sets of compensation pattern data consisting of a plurality of sets of compensation values, and wherein said control program includes a routine for selecting one of said plurality of kinds of compensation data, and selecting one of said plurality of sets of compensation pattern data for the designated kind of compensation data.

* * * * *